US010087034B2

(12) United States Patent
Awano

(10) Patent No.: US 10,087,034 B2
(45) Date of Patent: Oct. 2, 2018

(54) RECORDING MATERIAL PROCESSING APPARATUS AND IMAGE FORMING SYSTEM

(71) Applicant: FUJI XEROX CO., LTD., Minato-ku, Tokyo (JP)

(72) Inventor: Hiroaki Awano, Yokohama (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/478,749

(22) Filed: Apr. 4, 2017

(65) Prior Publication Data

US 2018/0086589 A1 Mar. 29, 2018

(30) Foreign Application Priority Data

Sep. 26, 2016 (JP) ..... 2016-187347
Sep. 26, 2016 (JP) ..... 2016-187348

(51) Int. Cl.
*B65H 37/04* (2006.01)
*G03G 15/00* (2006.01)

(52) U.S. Cl.
CPC ..... *B65H 37/04* (2013.01); *G03G 15/6544* (2013.01); *B65H 2301/5161* (2013.01); *B65H 2402/31* (2013.01); *B65H 2801/27* (2013.01)

(58) Field of Classification Search
CPC ..... B65H 37/04; B65H 2801/27; B65H 2301/5161; B65H 2301/4382; B31F 5/00; G03G 2215/00822; G03G 15/6541; G03G 15/6544
USPC ..... 270/58.08, 58.09
See application file for complete search history.

(56) References Cited

U.S. PATENT DOCUMENTS 6,394,442 B1 * 5/2002 Antinora ..... B42C 1/12 270/58.08
8,297,610 B2 * 10/2012 Shiraishi ..... B65H 37/04 270/58.08
8,540,228 B2 * 9/2013 Shiraishi ..... B42C 1/12 270/58.07
9,567,183 B2 * 2/2017 Komiyama ..... B42B 5/08
9,567,184 B2 * 2/2017 Kanemaru ..... B65H 31/02
2015/0166295 A1 * 6/2015 Kanemaru ..... B65H 31/02 270/58.08
2015/0183610 A1 7/2015 Matsuki et al.
2015/0360899 A1 * 12/2015 Takahashi ..... B65H 31/26 270/58.08
2016/0159605 A1 * 6/2016 Miyahara ..... G03G 15/6544 270/1.01

(Continued)

FOREIGN PATENT DOCUMENTS

JP 2015124084 A 7/2015
JP 2016-204071 A * 12/2016

*Primary Examiner* — Leslie A Nicholson, III
(74) *Attorney, Agent, or Firm* — Sughrue Mion, PLLC

(57) ABSTRACT

Provided is a recording material processing apparatus including: a first binding processing unit that is provided to be capable of moving on a predetermined movement route and is configured to perform a binding process on a recording material; and a second binding processing unit that is installed on the predetermined movement route, is configured to perform the binding process on the recording material, and is configured to withdraw from the movement route by receiving force from the first binding processing unit which moves along the movement route.

15 Claims, 7 Drawing Sheets

(56) References Cited

U.S. PATENT DOCUMENTS

2016/0194173 A1* 7/2016 Okada ..... B65H 37/04
270/58.09

* cited by examiner

RECORDING MATERIAL PROCESSING APPARATUS AND IMAGE FORMING SYSTEM

CROSS REFERENCE TO RELATED APPLICATION

This application is based on and claims priorities under 35 USC 119 from Japanese Patent Application No. 2016-187347 filed on Sep. 26, 2016 and Japanese Patent Application No. 2016-187348 filed on Sep. 26, 2016.

BACKGROUND

Technical Field

The present invention relates to a recording material processing apparatus and an image forming system.

SUMMARY

In a case where respective binding processing units are moved and driving sources are provided to correspond to the respective binding processing units in a recording material processing apparatus that is provided with the plural binding processing units, the number of driving sources increases, thereby causing a size of the device to be increased and causing costs to be increased.

An object of the invention is to move plural binding processing units by a smaller number of driving sources compared to a case where the driving sources are provided to correspond to the plural respective binding processing units.

According to an aspect of the invention, there is provided a recording material processing apparatus comprising:

a first binding processing unit that is provided to be capable of moving on a predetermined movement route and is configured to perform a binding process on a recording material; and a second binding processing unit that is installed on the predetermined movement route, is configured to perform the binding process on the recording material, and is configured to withdraw from the movement route by receiving force from the first binding processing unit which moves along the movement route.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments for realizing the present invention will be described with reference to the accompanying drawings.

Figure 1:
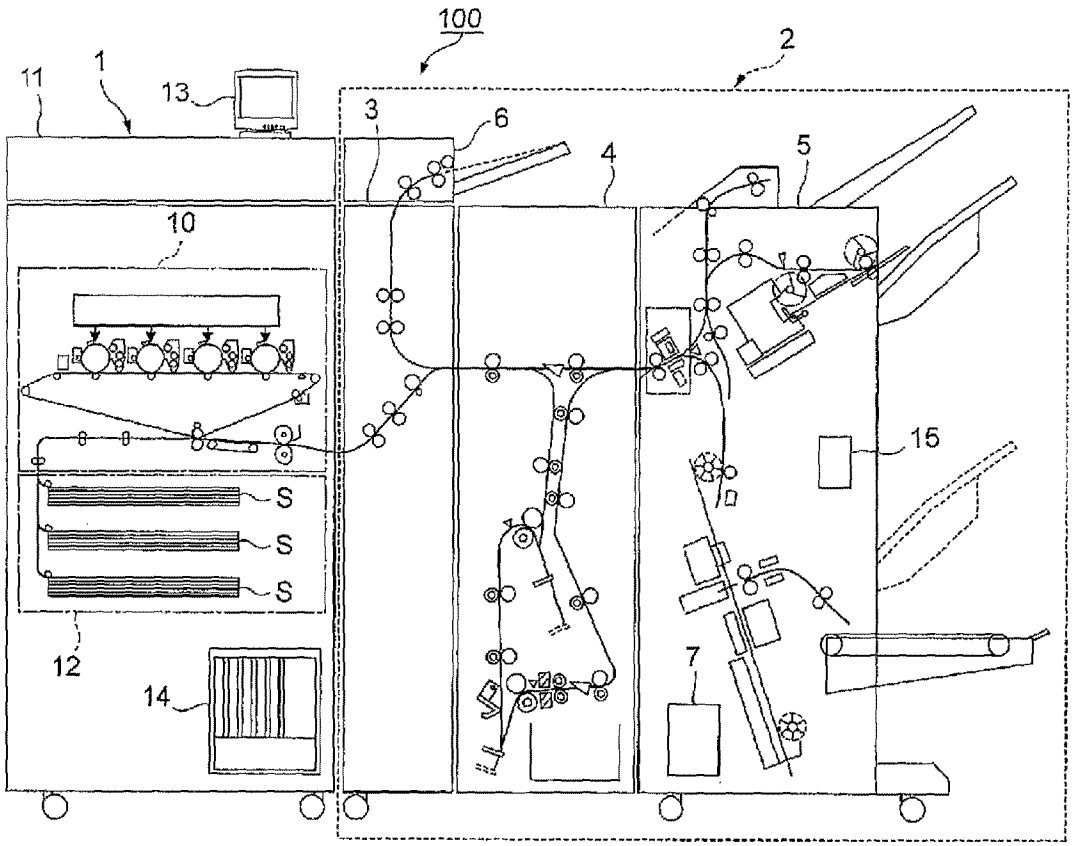
FIG. 1 is a view illustrating a whole configuration of an image forming system.

FIG. 1 is a view illustrating a whole configuration of an image forming system 100.

The image forming system 100 is provided with an image forming apparatus 1 and a post processing apparatus 2.

The image forming apparatus 1 forms a color image on a sheet S, which is an example of a recording material, using, for example, an electrophotographic system. In addition, the post processing apparatus 2 performs post processing on the sheet S on which the image is formed by the image forming apparatus 1.

The image forming apparatus 1 includes an image formation unit 10 that forms an image based on each color image data, an image reading unit 11 that reads an image from an original document and generates read image data, a sheet supplying unit 12 that supplies the sheet S to the image formation unit 10, a general user interface 13 that receives an operational input from a user and presents information to the user, and a main control unit 14 that controls a whole operation of the image forming system 100.

The post processing apparatus 2 is provided with a transport unit 3 that receives the sheet S, on which the image is formed, from the image forming apparatus 1 and transports the sheet S, a folding unit 4 that performs a folding process on the sheet S which is imported from the transport unit 3, a finisher unit 5 that performs a final process on the sheet S which passes through the folding unit 4, and an interposer 6 that supplies articulating paper which is used as a cover of a book or the like.

Furthermore, the post processing apparatus 2 is provided with a sheet processing control unit 7 that controls respective functional units of the post processing apparatus 2, and a User Interface (UI) 15 that receives the operational input relevant to the post processing from the user.

Meanwhile, in the exemplary embodiment, a configuration example in which the sheet processing control unit 7 is provided in the post processing apparatus 2 is illustrated. However, the sheet processing control unit 7 may be provided in the image forming apparatus 1.

In addition, the main control unit 14 may be configured to also have a control function of the sheet processing control unit 7.

In addition, in the exemplary embodiment, a configuration example in which the user interface 15 is provided in the post processing apparatus 2 is illustrated. However, the user interface 15 may be provided in the image forming apparatus 1. In addition, the general user interface 13 may be configured to also have a function of the user interface 15.

<Description of Post Processing Apparatus 2>

Figure 2:
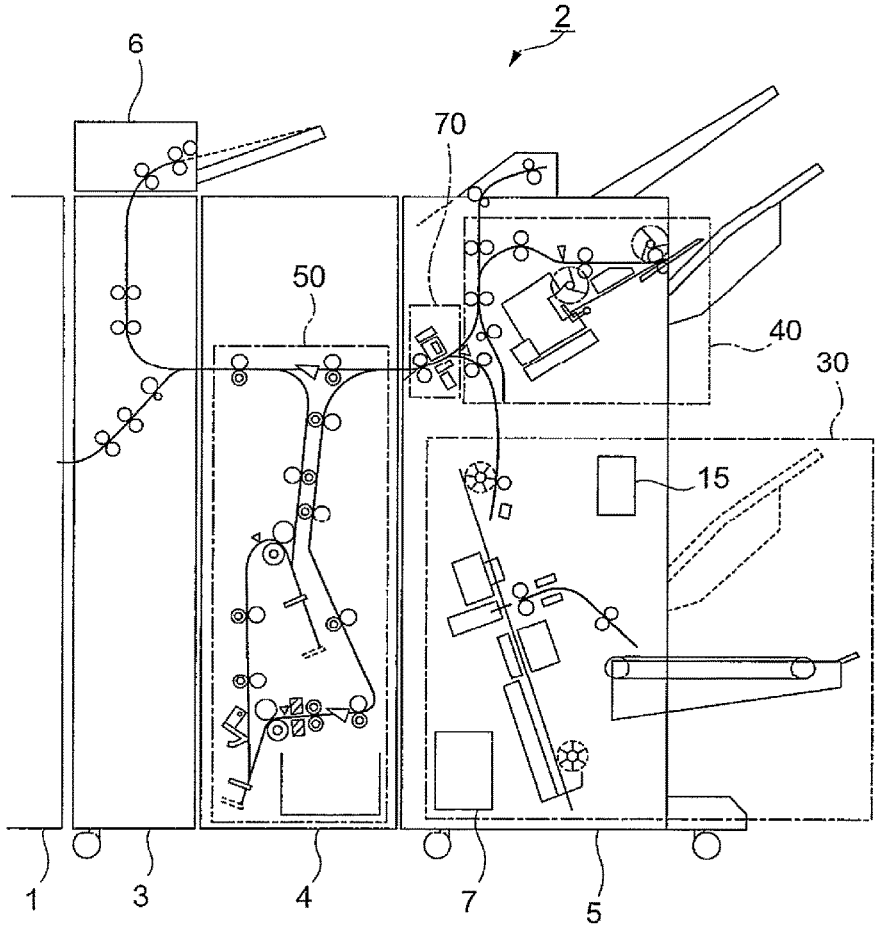
FIG. 2 is a view illustrating a post processing apparatus.

FIG. 2 is a view illustrating the post processing apparatus 2.

The post processing apparatus 2 is provided with the finisher unit 5 that is an example of a recording material processing apparatus. Furthermore, the finisher unit 5 is provided with a punch functional unit 70 that applies drilling (punching), such as two holes or four holes, on the sheet S, and an end binding functional unit 40 that generates a sheet bundle by accumulating the sheet S corresponding to a necessary number, and performs a binding process (end binding process) on an end part of the sheet bundle.

In addition, the post processing apparatus 2 is provided with a saddle binding bookbinding functional unit 30 that generates a sheet bundle by accumulating the sheet S corresponding to a necessary number, performs a binding process (saddle binding process) on a central part of the sheet bundle, and generates a brochure (booklet) (performs a bookbinding work).

In addition, the folding unit 4 of the post processing apparatus 2 is provided with a folding functional unit 50 that performs inner three folding (C-folding), outer three folding (Z-folding), and the like on the sheet S.

<Description of End Binding Functional Unit 40>

Figure 3:
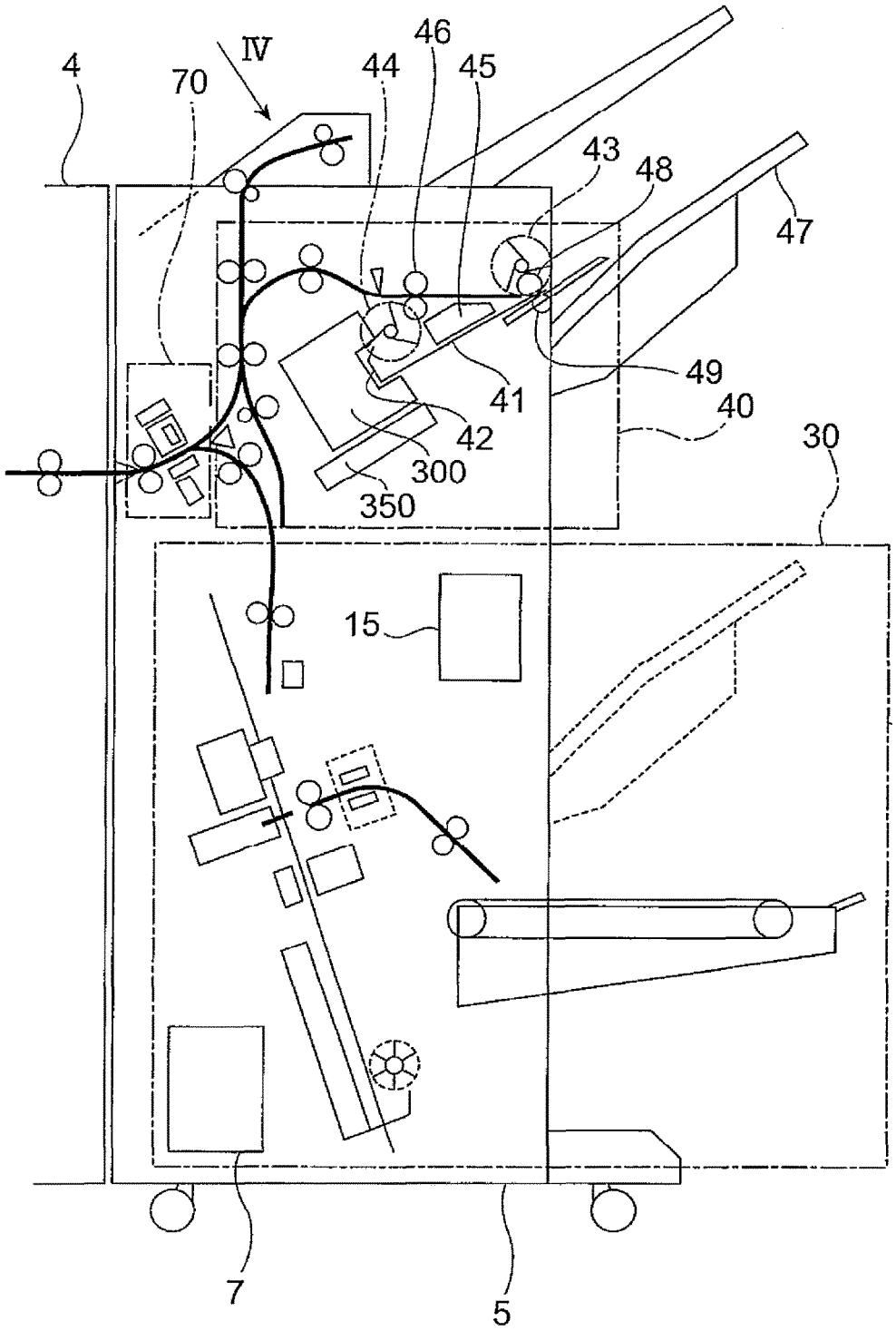
FIG. 3 is a view illustrating an end binding functional unit.

FIG. 3 is a view illustrating the end binding functional unit 40.

The end binding functional unit 40 is provided with a sheet loading unit 41 to which the transported sheet S is loaded. The sheet loading unit 41 is formed in a plate shape, and supports the loaded sheet S from below.

The sheet loading unit 41 is disposed in an inclined state such that an end part on a right side of the drawing is located above an end part on a left side of the drawing.

Furthermore, the end binding functional unit 40 is provided with a first rotation paddle 43 and a second rotation paddle 44 that energize the sheet S, which is supplied to the sheet loading unit 41, toward an end guide 42 which is provided at an end part of the sheet loading unit 41.

In the exemplary embodiment, the sheet S is pressed to the end guide 42 by the first rotation paddle 43 and the second rotation paddle 44, and thus the sheet S is aligned.

In addition, in the exemplary embodiment, a width direction alignment member 45 that aligns the sheet S in a width direction is provided. Two width direction alignment members 45 are provided, and one of the two width direction alignment members 45 is illustrated in FIG. 3. Another width direction alignment member 45 is located on the back side of the one width direction alignment member 45 in the drawing.

In the exemplary embodiment, whenever the sheet S is supplied to the sheet loading unit 41, the sheet S is interposed between the two width direction alignment members 45. In other words, the width direction alignment members 45 are pressed against the sheet S. Therefore, the width direction of the sheet S is aligned.

Furthermore, the end binding functional unit 40 is provided with a feeding roller 46 that feeds the sheet S, which is sent from the upstream side, toward the sheet loading unit 41.

In addition, a discharging roller 48 that discharges the sheet bundle (sheet bundle on which the binding process is performed), which is generated by the sheet loading unit 41, to a sheet bundle loading unit 47 is provided.

The discharging roller 48 is provided to be capable of moving forward and backward against the sheet loading unit 41, and withdraws from the sheet loading unit 41 in a case where a new sheet S is sequentially supplied to the sheet loading unit 41. Furthermore, in a case where a sheet bundle is generated by the sheet loading unit 41, the discharging roller 48 advances toward the sheet loading unit 41.

Therefore, the sheet bundle is interposed between the discharging roller 48 and a counter roller 49 that is located in a counter location of the discharging roller 48. Thereafter, in the exemplary embodiment, the counter roller 49 is driven to be rotated, and thus the sheet bundle is discharged to the sheet bundle loading unit 47.

Furthermore, in the exemplary embodiment, a first binding unit 300 is provided as an example of the first binding processing unit that performs the binding process on the sheet bundle on the sheet loading unit 41.

In addition, a second binding unit 500 (not illustrated in FIG. 3) that is retrofitted is provided on the back side of the first binding unit 300 (rear side (back surface side) of the finisher unit 5).

Here, the second binding unit 500 that is an example of the second binding processing unit performs the binding process using a different binding method from the first binding unit 300.

Therefore, in a case where the second binding unit 500 is installed, the binding process is performed on the sheet bundle using two types of binding methods in the end binding functional unit 40 according to the exemplary embodiment.

Here, in the exemplary embodiment, the second binding unit 500 is configured to be retrofitted, and thus being different from a configuration in which the second binding unit 500 is initially installed.

Therefore, the user may not purchase the finisher unit 5 in which the second binding unit 500 is installed in advance if the second binding unit 500 is not necessary. In other words, the user may not purchase the finisher unit 5 that performs two types of binding if the two types of binding are not necessary.

Furthermore, in the exemplary embodiment, a guide member 350 that guides the first binding unit 300 which moves is provided in the end binding functional unit 40, as illustrated in FIG. 3.

A guide groove (not illustrated in FIG. 3) that extends along a direction which is orthogonal to the paper surface of FIG. 3 is formed in the guide member 350, and a part of the first binding unit 300 enters the guide groove.

Since a part of the first binding unit 300 is guided by the guide member 350, the first binding unit 300 moves along a movement route in advance. Furthermore, a moving mechanism (not illustrated in the drawing) that moves the first binding unit 300 is provided in the end binding functional unit 40.

The moving mechanism includes a circular belt member that extends along a depth direction of the finisher unit 5 to which the first binding unit 300 is attached, a pulley that rotates (circles) the belt member, and a drive motor that rotates the pulley.

In the exemplary embodiment, the first binding unit 300 moves in such a way that the drive motor is controlled by the sheet processing control unit 7, and, furthermore, the first binding unit 300 stops at a predetermined binding position.

Figure 4:
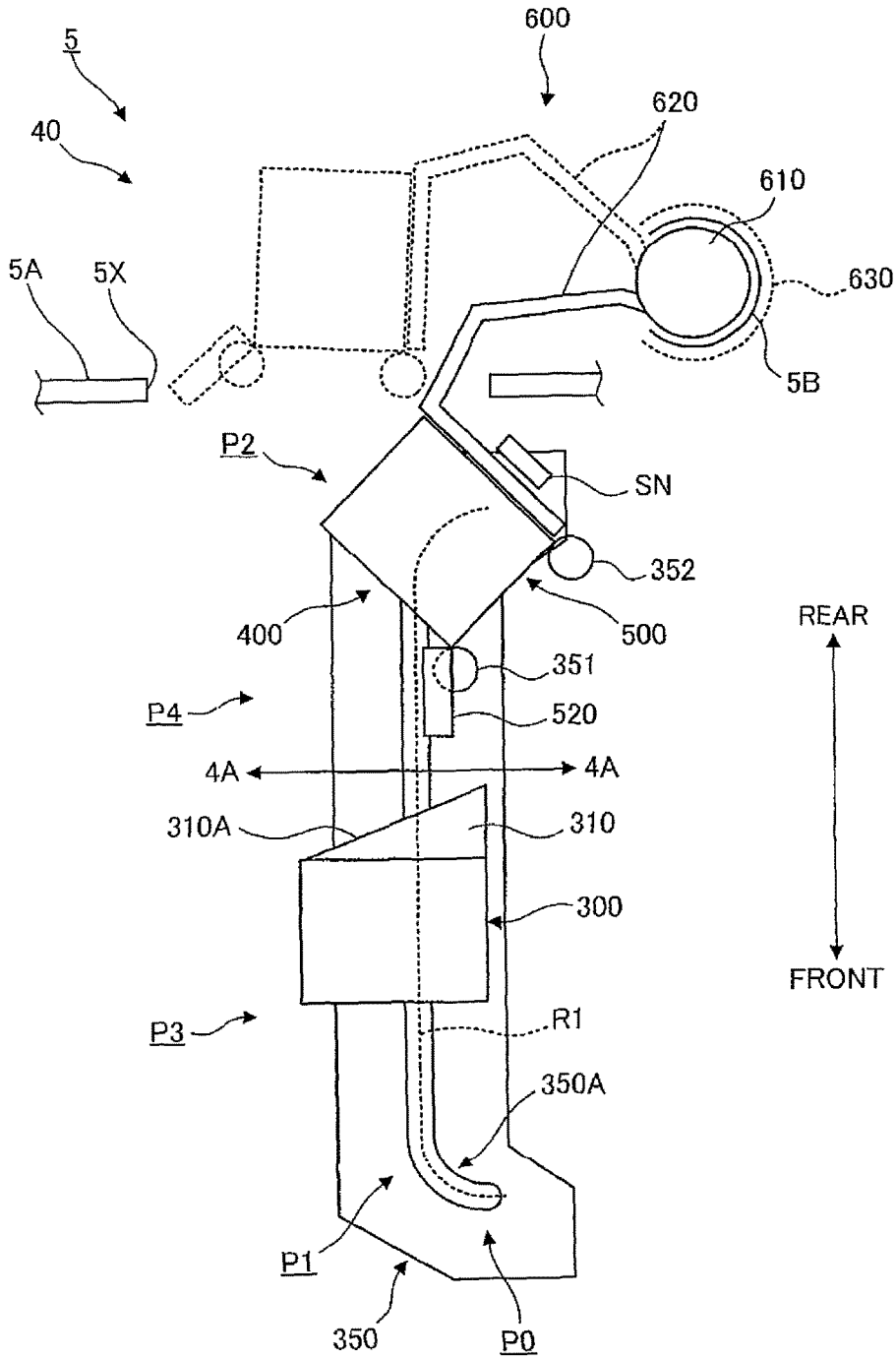
FIG. 4 is a view illustrating a case where a first binding unit or the like is viewed from a direction of an arrow IV in FIG. 3.

FIG. 4 is a view illustrating a case where the first binding unit 300 or the like is viewed from a direction of an arrow IV in FIG. 3. Meanwhile, the sheet loading unit 41 or the like is not illustrated in FIG. 4.

As described above or as illustrated in FIG. 4, the first binding unit 300 is provided in the end binding functional unit 40. In addition, the guide member 350 that guides the first binding unit 300 is provided.

A guide groove 350A is formed in the guide member 350, and the first binding unit 300 moves along the guide groove 350A. In the exemplary embodiment, a movement route R1 is provided along the guide groove 350A, and the first binding unit 300 moves along the movement route R1.

Furthermore, the guide member 350 has an installation portion 400 provided on the rear side (on a side of the back surface 5A of the finisher unit 5 rather than the first binding unit 300) rather than the first binding unit 300, and the second binding unit 500 is installed in the installation portion 400. More specifically, the second binding unit 500 is retrofitted in the installation portion 400.

The installation portion 400 is located on the movement route R1, and, accordingly, the second binding unit 500 that is installed in the installation portion 400 is also located on the movement route R1.

Furthermore, in the exemplary embodiment, a withdrawal mechanism 600 that withdraws the second binding unit 500 out of the movement route R1 is provided.

The withdrawal mechanism 600 is provided with a rotation shaft 610, and a connection member 620 that connects the rotation shaft 610 to the second binding unit 500.

Furthermore, a spring member 630, such as a torsion spring, is provided around the rotation shaft 610 as an example of an energizing unit.

In the exemplary embodiment, the connection member 620 is energized by the spring member 630 such that the connection member 620 moves in a counterclockwise direction in the drawing. Furthermore, the second binding unit 500 is energized toward the movement route R1 through the energization.

In the exemplary embodiment, in a case where the second binding unit 500 is retrofitted, the withdrawal mechanism 600 is also retrofitted.

A hole 5B, into which the rotation shaft 610 is inserted, is formed in the finisher unit 5. In a case where the withdrawal mechanism 600 is installed in the finisher unit 5, the rotation shaft 610 is inserted into the hole 5B, and thus the withdrawal mechanism 600 is installed.

Meanwhile, in a step before the second binding unit 500 and the withdrawal mechanism 600 are installed (in a factory shipment step), an end guide 42 illustrated in FIG. 3 is provided in the installation portion 400 in which the second binding unit 500 is installed.

In a case where the second binding unit 500 is installed to the installation portion 400, apart (a part of the end guide 42 which interferes in the second binding unit 500) of the end guide 42 is detached, and the second binding unit 500 is installed.

Furthermore, in the exemplary embodiment, a sensor SN is provided to detect that the second binding unit 500 is located in the installation portion 400, as illustrated in FIG. 4.

In other words, the sensor SN is provided as an example of a detection unit that detects that the second binding unit 500 is located on the movement route R1.

Here, in the exemplary embodiment, in a case where an output from the sensor SN is output to the sheet processing control unit 7 and the second binding unit 500 is detected by the sensor SN, the sheet processing control unit 7 outputs a signal which causes the binding process to be performed to the second binding unit 500.

In contrast, in a case where the second binding unit 500 is not detected by the sensor SN, the sheet processing control unit 7 does not output the signal which causes the binding process to be performed.

Therefore, the second binding unit 500 is prevented from being operated in a state in which the second binding unit 500 is separated from the binding position (a state in which the second binding unit 500 withdraws from the installation portion 400).

In addition, in the exemplary embodiment, a plate-shaped cam 310 is provided in the first binding unit 300, as illustrated in FIG. 4. An inclined surface 310A is provided in the cam 310.

The inclined surface 310A is inclined against a direction (a direction which is indicated by a symbol 4A in the drawing) which is orthogonal to a direction in which the movement route R1 extends.

Furthermore, a first guided member 351 and a second guided member 352, which are formed in a disk shape, are provided to be capable of rotating, and are guided by the inclined surface 310A of the cam 310, are provided in the second binding unit 500.

In addition, a sheet stopping unit 520 is provided in the second binding unit 500. In the sheet stopping unit 520, the sheet S on the sheet loading unit 41 (see FIG. 3) stops, and thus the sheet S is aligned.

Specifically, in the exemplary embodiment, in a case where the sheet S is loaded on the sheet loading unit 41, the sheet S stops at the sheet stopping unit 520 of the second binding unit 500 by the first rotation paddle 43 (see FIG. 3) and the second rotation paddle 44, and thus the sheet S is aligned.

More specifically, in the case where the sheet S is loaded on the sheet loading unit 41, the sheet S stops at the end guide 42 (see FIG. 3) and the sheet stopping unit 520 of the second binding unit 500 by the first rotation paddle 43 and the second rotation paddle 44, and thus the sheet S is aligned.

Furthermore, in the exemplary embodiment, as described above, in a case where the second binding unit 500 is installed, a part of the end guide 42 is detached, and the sheet stopping unit 520 of the second binding unit 500 is installed instead of the part of the end guide 42.

After the second binding unit 500 is installed, the sheet S stops against the remaining end guide 42 and the sheet stopping unit 520 of the second binding unit 500, and thus sheet S is aligned.

Meanwhile, here, a case in which a part of the end guide 42 is detached is described as an example. However, the invention is not limited thereto. For example, a part of the end guide 42 may be provided to be capable of moving and the part of the end guide 42 may move to a position which does not interfere in the second binding unit 500.

Here, in the exemplary embodiment, four binding positions are set as positions in which the binding is performed by the first binding unit 300.

Specifically, as illustrated in FIG. 4, a first binding position P1 in which the binding process is performed on one corner of the sheet S, a second binding position P2 in which the binding process is performed on another corner of the sheet S, a third binding position P3 in which the binding process is performed on a side of the sheet S, and a fourth binding position P4 in which the binding process is performed on a side of the sheet S similarly are set.

In the exemplary embodiment, the second binding unit 500 is installed in the second binding position P2, and the second binding unit 500 performs the binding process on the corner of the sheet S.

Here, in the exemplary embodiment, the second binding position P2 is a position in which both the first binding unit 300 and second binding unit 500 perform the binding process.

In the exemplary embodiment, in a case where the second binding unit 500 performs the binding process in the second binding position P2, the first binding unit 300 is located in a position other than the second binding position P2.

In addition, in a case where the first binding unit 300 performs the binding process in the second binding position P2, the second binding unit 500 withdraws to the side of the movement route R1. Furthermore, the first binding unit 300 stops at a position where the second binding unit 500 is located before withdrawing, and performs the binding process on the sheet bundle.

In addition, in the exemplary embodiment, the first binding unit 300 performs the binding process on the sheet bundle using a staple needle (binding needle).

In addition, the second binding unit 500 performs the binding process on the sheet bundle by interposing the sheet bundle between two pressing tooth (not illustrated in the drawing) and entangling fibers of the sheet S. In other words, the second binding unit 500 performs the binding process on the sheet bundle without using the staple needle.

Here, it is necessary to replenish the staple needle for the first binding unit 300. In a case of the replenishment, the first binding unit 300 is moved to a position which is indicated by a symbol P0 of FIG. 4. Specifically, the first binding unit 300 is moved to a front surface side of the finisher unit 5.

Meanwhile, as described above, in a configuration in which the first binding unit 300 is moved to a front surface side of the finisher unit 5, if the second binding unit 500 is similarly located on the front surface side, there is a problem in that it is difficult to perform a replenishment work for the staple needle.

Therefore, in the exemplary embodiment, a configuration is provided in which the installation portion 400 is provided on a side of the back surface 5A of the finisher unit 5 and the second binding unit 500 is provided on a side opposite to the front surface side on which the staple needle is replenished.

FIGS. 5A to 5D are views illustrating the motions of the first binding unit 300 and the second binding unit 500. Meanwhile, FIGS. 5A to 5D illustrate motions of respective units in a case where the first binding unit 300 moves to the second binding position P2 and performs the binding process.

Figure 5A:
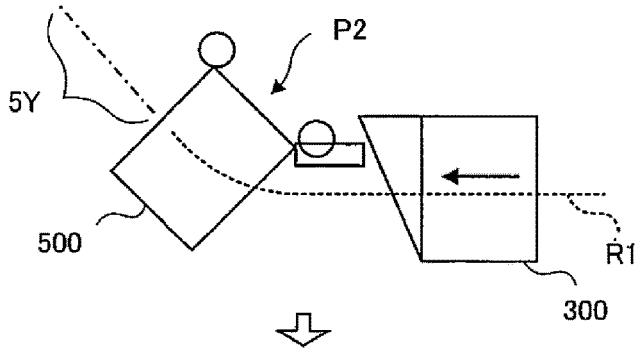
FIGS. 5A to 5D are views illustrating motions of the first binding unit and a second binding unit.

FIG. 5A is a view illustrating states of the first binding unit 300 and the second binding unit 500 while the first binding unit 300 is moving to the second binding position P2.

In the states, the first binding unit 300 does not touch the second binding unit 500, and both the first binding unit 300 and the second binding unit 500 are located on the movement route R1.

Figure 5B:
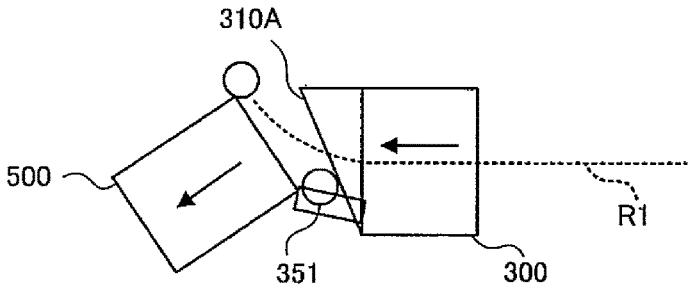

FIG. 5B is a view illustrating a state after the second binding unit 500 is pressed by the first binding unit 300.

In a case where the first binding unit 300 reaches a predetermined position, the inclined surface 310A comes into contact with the first guided member 351, and thus the first guided member 351 is pressed.

Therefore, the second binding unit 500 starts to move aside from the movement route R1 (laterally to the movement route R1). Here, it is possible to understand the first binding unit 300 as a movement unit which moves the second binding unit 500 aside from the movement route R1.

Figure 5C:
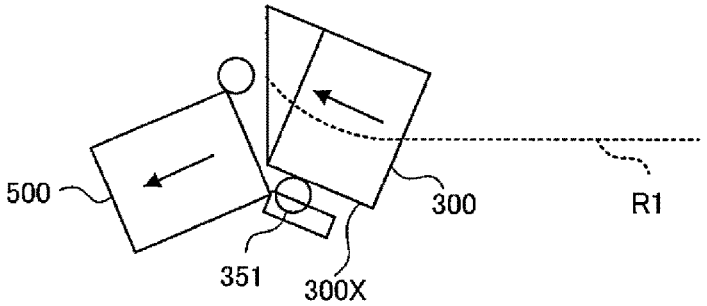

In a case where the first binding unit 300 further moves, the states of the first binding unit 300 and the second binding unit 500 become states illustrated in FIG. 5C.

In the states, the first guided member 351 becomes a state in which the first guided member 351 is pressed by a back surface 300X of the first binding unit 300. Furthermore, the second binding unit 500 moves to a position which is further separated from the movement route R1.

Figure 5D:
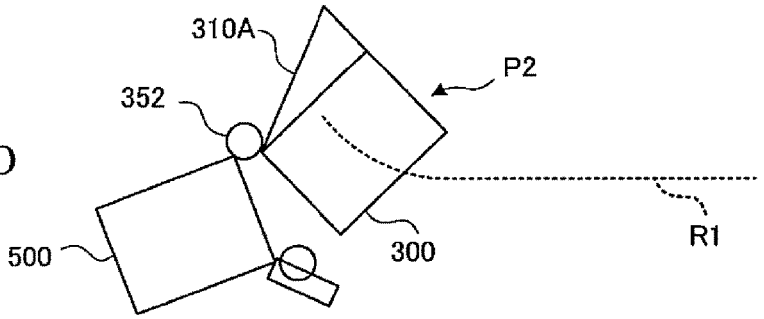

In a case where the first binding unit 300 further moves, the states of the first binding unit 300 and the second binding unit 500 become states illustrated in FIG. 5D.

In the states, the second guided member 352 becomes a state in which the second guided member 352 is pressed by the inclined surface 310A of the first binding unit 300. Furthermore, in the states, the first binding unit 300 reaches the second binding position P2, and the second binding unit 500 withdraws to the side of the movement route R1.

Here, in the exemplary embodiment, a position to which the second binding unit 500 withdraws is a side of the movement route R1, and is a position other than an extended line of the movement route R1.

In other words, the second binding unit 500 withdraws to the side of the movement route R1, and does not withdraw to the extended line of the movement route R1.

Here, for example, it is possible to extend the movement route R1 illustrated in FIG. 5A as the position, to which the second binding unit 500 withdraws, as being illustrated by a symbol 5Y in the drawing and it is possible to designate the extended part to the position to which the second binding unit 500 withdraws.

However, in this case, a depth dimension of the finisher unit 5 is likely to be large. Therefore, in the exemplary embodiment, the second binding unit 500 withdraws to the side of the movement route R1, and thus the depth dimension of the finisher unit 5 is prevented from being large.

Meanwhile, in a case where the first binding unit 300 moves from the second binding position P2 to another binding position, such as the first binding position P1, an operation reverse to the above is performed.

Specifically, the first binding unit 300 moves to another binding position from the second binding position P2. Subsequently, the second binding unit 500 returns to the movement route R1 by the spring member 630 illustrated in FIG. 4.

Figure 6:
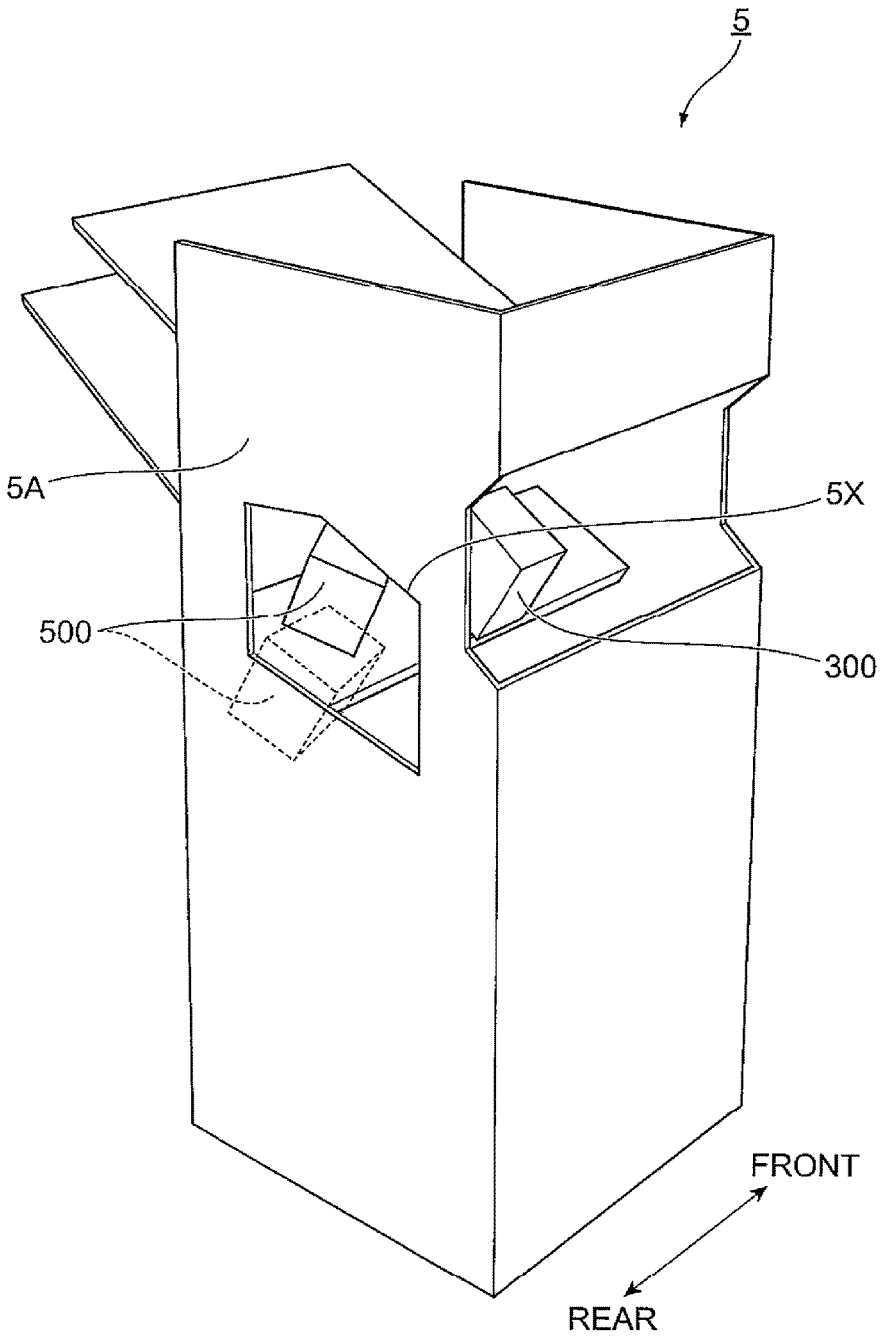
FIG. 6 is a view illustrating a case where a finisher unit is viewed from a rear side.

FIG. 6 is a view illustrating a case where the finisher unit 5 is viewed from a rear side.

As illustrated in FIG. 6, an opening (through hole) 5X is formed in the back surface 5A of the finisher unit 5. Furthermore, in the exemplary embodiment, an exterior cover (not illustrated in the drawing) is provided in a counter position of the back surface 5A. In a case where the second binding unit 500 is installed, the exterior cover is detached, and, thereafter, the second binding unit 500 is installed inside the finisher unit 5 through the opening 5X.

Here, in the exemplary embodiment, in a case where the second binding unit 500 withdraws from the movement route R1 as illustrated in FIGS. 4 and 6, the second binding unit 500 comes out to an outside of (a housing of) the finisher unit 5 through the opening 5X.

Meanwhile, after the second binding unit 500 is installed, a new exterior cover, which includes a recess (a recess which prevents interference between the second binding unit 500 and the exterior cover) on a inner surface such that aback surface of the exterior cover is projected toward the outside, is attached instead of the detached exterior cover.

Other Embodiments

In the above-described exemplary embodiment, the first binding unit 300 is pressed to the second binding unit 500, and thus the second binding unit 500 withdraws from the movement route R1. However, an aspect in which the second binding unit 500 withdraws is not limited thereto. For example, a motor or the like which withdraws the second binding unit 500 may be installed (a mechanism which withdraws the second binding unit 500 may be additionally installed) and the second binding unit 500 may withdraw from the movement route R1 by the motor or the like.

In addition, in the above, in a case where the first binding unit 300 reaches the second binding position P2, the second binding unit 500 withdraws to the side of the movement route R1. However, a timing in which the second binding unit 500 withdraws to the side of the movement route R1 is not limited thereto. For example, the second binding unit 500 may withdraw at a timing in which the first binding unit 300 starts to move.

In addition, in a case where the second binding unit 500 withdraws by a driving source, the driving source which moves the first binding unit 300 and the second binding unit 500 may be shared.

Figure 7:
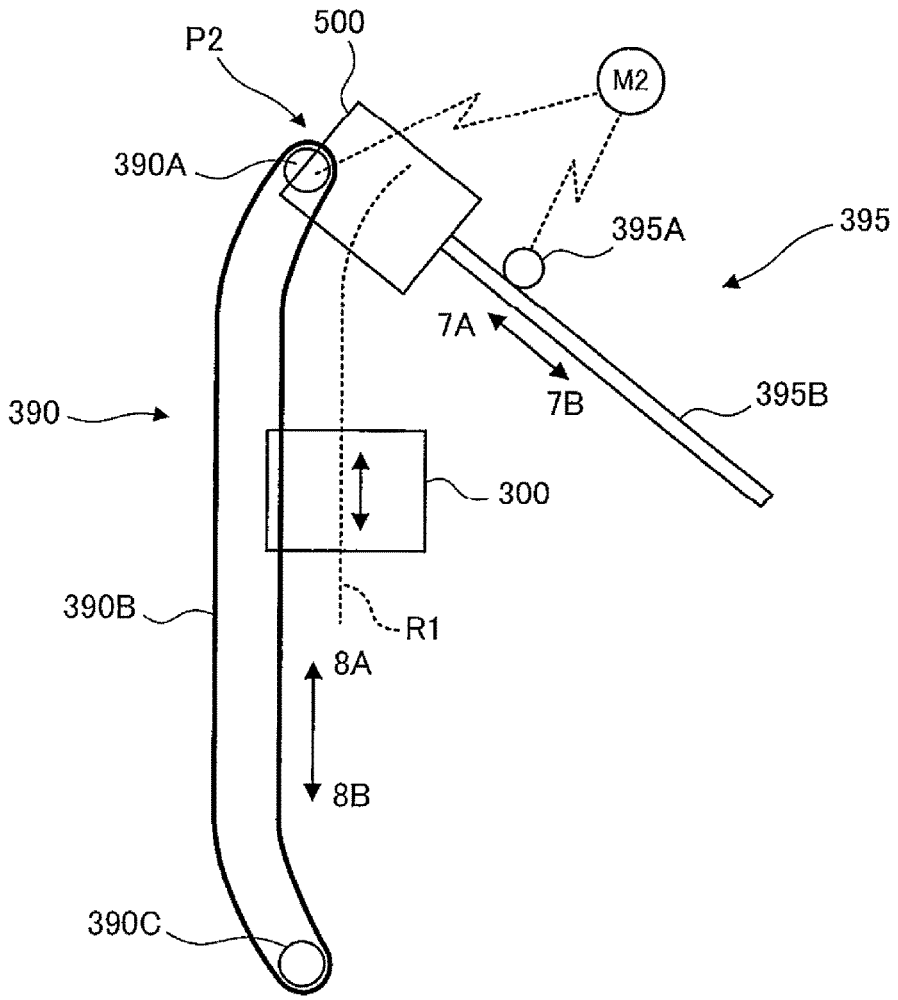
FIG. 7 is a view illustrating an example of a moving mechanism that moves the first binding unit and the second binding unit.

FIG. 7 is a view illustrating an example of a moving mechanism that moves the first binding unit 300 and the second binding unit 500. In the moving mechanism, one drive motor M2 is provided and thus a driving source is shared.

Specifically, in a configuration example, a first moving mechanism 390 that moves the first binding unit 300 using drive force from the drive motor M2 and a second moving mechanism 395 that moves the second binding unit 500 using drive force from the drive motor M2 are provided.

The first moving mechanism 390 is provided with a pulley 390A that rotates by receiving the drive force from the drive motor M2, a belt member 390B that is moved by the pulley 390A, and a support member 390C that is provided to be capable of rotating and supports the belt member 390B.

In addition, the second moving mechanism 395 is provided with a pinion gear 395A that rotates by receiving the drive force from the drive motor M2, and a rack gear 395B that extends along a direction which intersects with the movement route R1. The second binding unit 500 is fixed to the rack gear 395B.

Here, in the configuration example, in a case where the second binding unit 500 withdraws from the second binding position P2 and, furthermore, the first binding unit 300 moves to the second binding position P2, the drive motor M2 rotates in one direction.

Therefore, for example, the rack gear 395B moves in a direction indicated by an arrow 7A and the second binding unit 500 withdraws from the movement route R1. In addition, the belt member 390B rotates in a direction indicated by an arrow 8A and the first binding unit 300 moves to the second binding position P2.

In a case where the second binding unit 500 returns to the second binding position P2, the drive motor M2 is reversed. Therefore, the rack gear 395B moves in a direction indicated by an arrow 7B and the second binding unit 500 returns to the movement route R1. In addition, the belt member 390B rotates in a direction indicated by an arrow 8B and the first binding unit 300 moves to positions other than the second binding position P2.

What is claimed is:

1. A recording material processing apparatus comprising:

a first binding processing unit configured to move on a movement route and to perform a first binding process on a recording material; and a second binding processing unit that is installed on the movement route, is configured to perform a second binding process on the recording material, and is configured to withdraw from the movement route in response to receiving force from the first binding processing unit which moves along the movement route.

2. The recording material processing apparatus according to claim 1, wherein the second binding processing unit is configured to withdraw out of the movement route.

3. The recording material processing apparatus according to claim 2, wherein the second binding processing unit is configured to withdraw out of the movement route to a location other than an extended line of the movement route.

4. The recording material processing apparatus according to claim 1, further comprising:

an energizing unit configured to energize the second binding processing unit toward the movement route.

5. The recording material processing apparatus according to claim 1, further comprising:

a detection unit configured to detect that the second binding processing unit is located on the movement route.

6. The recording material processing apparatus according to claim 1, wherein the first binding processing unit is configured to stop at a position at which the second binding processing unit is positioned before the second binding processing unit withdraws.

7. The recording material processing apparatus according to claim 1, wherein the first binding processing unit is configured to perform the first binding process using a binding needle, and wherein the second binding processing unit is provided on a back surface side of the recording material processing apparatus.

8. An image forming system comprising:

an image forming apparatus configured to form an image on a recording material; and a recording material processing apparatus configured to perform a binding process on the recording material on which the image has been formed by the image forming apparatus, wherein the recording material processing apparatus includes the recording material processing apparatus according to claim 1.

9. A recording material processing apparatus comprising:

a first binding processing unit that configured to move on a movement route and to perform a first binding process on a recording material;

a second binding processing unit configured to perform a second binding process on the recording material;

an installation portion positioned on the movement route, wherein the second binding processing unit is installed on the installation portion; and a movement mechanism configured to move the second binding processing unit out of the movement route, wherein the second binding processing unit is configured to withdraw out of the movement route when the first binding processing unit contacts with the second binding processing unit and presses the second binding processing unit.

10. The recording material processing apparatus according to claim 9, wherein the movement mechanism is configured to move the second binding processing unit positioned on the installation portion out of the movement route when the first binding processing unit moves toward the installation portion or passes through the installation portion.

11. The recording material processing apparatus according to claim 9, wherein the second binding processing unit is configured to withdraw out of the movement route to a location other than an extended line of the movement route.

12. The recording material processing apparatus according to claim 9, wherein the first binding processing unit is configured to perform the first binding process using a binding needle, and wherein the installation portion is provided on a rear side of the recording material processing apparatus.

13. The recording material processing apparatus according to claim 9, further comprising:

a detection unit configured to detect that the second binding processing unit is located on the movement route.

14. An image forming system comprising:

an image forming apparatus configured to form an image on a recording material; and a recording material processing apparatus configured to perform a binding process on the recording material on which the image has been formed by the image forming apparatus, wherein the recording material processing apparatus includes the recording material processing apparatus according to claim 9.

15. A recording material processing apparatus comprising:

a first binding processing unit configured to move on a movement route and to perform a first binding process on a recording material; and a second binding processing unit that is installed on the predetermined movement route, is configured to perform a second binding process on the recording material, and is configured to move in response to receiving force from the first binding processing unit which moves along the movement route.

* * * * *